US005490457A

United States Patent [19]

Boulanger et al.

[11] Patent Number: 5,490,457

[45] Date of Patent: Feb. 13, 1996

[54] METHOD AND APPARATUS FOR PRINTING A FIBROUS WEB

[75] Inventors: Roger Boulanger, Ste-Julie; Flavio Metta, Longueuil; Réal Contant, Repentigny, all of Canada

[73] Assignee: Johnson & Johnson Inc., Quebec, Canada

[21] Appl. No.: 42,337

[22] Filed: Apr. 2, 1993

[30] Foreign Application Priority Data

Apr. 3, 1992 [CA] Canada ..... 2065121

[51] Int. Cl.[6] ..... B41M 1/10; B41F 9/10

[52] U.S. Cl. ..... 101/170; 101/150; 101/169; 101/157

[58] Field of Search ..... 101/150, 153, 101/154, 155, 156, 157, 158, 160, 161, 170, 395, 401.1, 167, 169; 162/119, 134, 184, 265; 118/212, 262

[56] References Cited

U.S. PATENT DOCUMENTS

| | | | |
|---|---|---|---|
| 935,612 | 9/1909 | Saalburg | 101/170 X |
| 1,742,516 | 4/1922 | Mills | 264/246 |
| 2,019,845 | 11/1935 | Colbert et al. | 162/124 |
| 3,630,835 | 12/1971 | Busch | 162/184 |
| 3,980,018 | 9/1976 | Ichikawa | 101/170 |
| 4,033,059 | 7/1977 | Hutton et al. | 101/150 X |
| 4,549,930 | 10/1985 | Dessauer | 162/134 |
| 4,715,623 | 12/1987 | Roule et al. | 101/150 X |
| 4,961,964 | 10/1990 | Dahlgren | 427/211 |

FOREIGN PATENT DOCUMENTS

| | | | |
|---|---|---|---|
| 1143929 | 4/1983 | Canada . | |
| 4034099 | 2/1992 | Japan | 162/134 |

OTHER PUBLICATIONS

Inta–Roto, In–Stock Engraved Applicator Rolls Brochure, 3 Jul. 1975.

*Primary Examiner*—Christopher A. Bennett
*Attorney, Agent, or Firm*—James P. Barr

[57] ABSTRACT

An apparatus for printing a fibrous web with a decorative pattern, comprising a printing roll having a cavity forming a shaped ink transfer zone to print a principal pattern on the fibrous web through rolling contact therewith, and an array of small recesses in a spaced apart relationship surrounding the cavity and having the ability to trap dirt particles adhering to the printing roll which are being trained over its relief surface by a doctor blade scraping excess ink therefrom. The array of recesses provides a cleaning action by continuously dislodging dirt particles collecting underneath the leading edge of the doctor blade and preventing the dirt particles from agglomerating into large flocs which may interfere with the operation of the doctor blade. The array of recesses also defines an ink transfer zone printing on the fibrous web a relatively faint background pattern upon which the principal pattern is visually eminent. The invention also extends to a method for conditioning a printing roll to prevent dirt particles from accumulating under a doctor blade used in association with the printing roll.

21 Claims, 7 Drawing Sheets

METHOD AND APPARATUS FOR PRINTING A FIBROUS WEB

FIELD OF THE INVENTION

The invention relates to the art of manufacturing fibrous materials marked with a print and, more particularly, to a novel printing roll, to an apparatus for printing a fibrous web and to a method for conditioning a printing roll for preventing clogging of a doctor blade by impurities, which is provided for scraping excess colorant from the relief surface of the printing roll.

BACKGROUND OF THE INVENTION

To enhance the aesthetical appearance of low cost fibrous webs, such as non-woven polishing or washing cloths, it is common practice in the industry to imprint on the fibrous web a decorative pattern. Typically, this operation is carried out immediately after the web has been formed, at a printing station operating according to the principle of a common printing press. The printing station comprises a printing roll which is engraved to form a shaped colorant transfer zone applying colorant, such as ink, according to a desired pattern on the surface of the fibrous web maintained in rolling contact with the printing roll.

When the colorant transfer surface is of a relatively small extent, having a maximum axial dimension (herein "axial dimension" shall mean the dimension measured along an imaginary line parallel to the rotation axis of the printing roll) less than the length of the printing roll, it has been observed that the printing station has a tendency to become clogged by dirt particles normally present in the environment of the printing station, such as small fibers released from the fibrous web or airborne impurities, which accumulate under the doctor blade provided to scrape excess colorant from the printing roll. When the build-up of particles increases beyond a certain point where the doctor blade is no longer capable of maintaining firm contact with the relief surface of the printing roll, excess colorant is carried over the fibrous web which produces undesirable spots or streaks.

A possible solution to this problem is to clean the doctor blade at short intervals to remove the build-up of impurities, however, this would require frequent interruptions of the entire production line.

SUMMARY OF THE INVENTION

An object of the invention is to provide a novel apparatus for printing a fibrous web, capable of operating for relatively long time periods without being clogged by dirt particles, such as small fibers and airborne impurities normally present in the environment of the apparatus.

Another object of the invention is to provide a novel printing roll for printing a fibrous web, capable of operating for relatively long time periods without clogging with dirt particles a doctor blade provided to scrape excess colorant from the relief surface of the printing roll.

Yet, another object of the invention is to provide a method for conditioning a printing roll used for printing a fibrous web to prevent frequent clogging of a doctor blade used in association with the printing roll, with dirt particles.

As embodied and broadly described herein, the invention provides an apparatus for printing a fibrous web, the apparatus comprising:

a rotary printing roll in rolling contact with the fibrous web for simultaneously printing thereon a principal pattern and a background pattern upon which the principal pattern is visually eminent, the printing roll including:

a) a generally cylindrical peripheral surface;

b) a first colorant transfer zone on the generally cylindrical peripheral surface defining a shaped cavity corresponding to the principal pattern and having a maximum axial dimension less than the length of the printing roll; and c) an array of recesses in a spaced apart relationship on the generally cylindrical peripheral surface, the array of recesses defining a second colorant transfer zone having a shape corresponding to the background pattern and substantially surrounding the first colorant transfer zone;

a colorant feed for coating the generally cylindrical peripheral surface with liquid colorant, the first colorant transfer zone having a higher colorant holding capacity per unit area of the generally cylindrical peripheral surface than the second colorant transfer zone, whereby the zones print on the fibrous web contrasting marks forming the principal and background patterns;

a stationary doctor blade scraping the generally cylindrical peripheral surface for removing excess colorant therefrom as the printing roll rotates, the doctor blade engaging dirt particles adhering on the generally cylindrical peripheral surface and training the dirt particles over the array of recesses which constitutes means for dislodging dirt particles accumulating against the doctor blade, thereby preventing the dirt particles from agglomerating into large flocs and interfering with the operation of the doctor blade.

By providing a multiplicity of recesses on the area of the printing roll surrounding the colorant transfer zone printing the principal pattern, the circumferential continuity of this area is disrupted, whereby dirt particles adhering to the printing roll can escape in the individual recesses and clear the doctor blade. Therefore, an undesirable build-up of waste matter under the doctor blade is less likely to occur, allowing to maintain the apparatus in operation for longer time periods without the necessity of frequent cleaning cycles.

The recesses of the array, formed in a spaced apart relationship on the peripheral surface of the printing roll define therebetween land areas (for the purpose of this specification "land area" shall mean a zone on the printing roll which is wiped clean of colorant by the doctor blade and does not create a mark on the fibrous web. According to this definition, the entire peripheral surface of the printing roll is a land area except the shaped cavities or recesses which carry the colorant to mark the fibrous web). In a preferred embodiment, every possible imaginary circumferential line contained a plane perpendicular to a rotational axis of the printing roll and passing through a land area intercepts at least one of the recesses of the array. As a result, irregardless of the axial position of a dirt particle held by the doctor blade, within a single revolution of the printing roll, at least one recess will pass underneath the particle allowing same to enter the recess and clear the doctor blade.

The array of recesses whose primary function is to trap dirt particles also constitutes a colorant transfer zone printing a mark on the fibrous web. The array of recesses is designed in such a way as to print a relatively faint background pattern upon which the primary pattern is visually eminent. This is achieved by creating the individual recesses relatively small and shallow and by spacing the recesses by a sufficient distance to leave voids of appreciable size between marks created on the fibrous web by adjacent recesses. As a result, the colorant holding capacity of the array of recesses per unit area of the peripheral surface of the printing roll is less than the colorant holding capacity of the cavity printing the primary pattern. Therefore, when the fibrous web is being printed, a higher volume of colorant per unit area is deposited on the surface marked by the cavity forming the principal pattern than on the surface marked by the array of recesses. The higher density print of the primary pattern contrasts with the background pattern which is less eminent in order to provide the desired visual distinction between the patterns.

It should be appreciated that the density of a print is essentially dependent upon two factors, namely the superficial extent of the shaped cavity carrying the colorant pellicle to the fibrous web and the depth of the cavity which determines the hiding power of the resulting mark. A shallow cavity of large extent will produce a large mark which is relatively faint because the colorant pellicle is so thin that it fails to totally obscure the surface upon which it is applied. By comparison, a mark covering a smaller surface but having a higher hiding power will appear to the eye more dense and visually distinctive.

Therefore, the visual distinctiveness between the primary and background patterns is determined by the ratio between the respective volumes, i.e. the colorant carrying capacity per unit area of the peripheral surface of the printing roll of the shaped cavities printing the two patterns. In a most preferred embodiment, the colorant carrying capacity per unit area of the colorant transfer zone printing the principal pattern is significantly higher than the colorant carrying capacity of the colorant transfer zone printing the background pattern.

In order to determine the colorant carrying capacity per unit area of a given colorant transfer zone, the calculated volume of the shaped cavity forming the said zone is divided by the superficial extent of the said zone, irregardless of the relief of the colorant transfer zone. A colorant transfer zone may be formed either by a continuous cavity or by a discontinuous cavity, i.e. a plurality of individual recesses separated by land areas. In the latter case, the superficial extent of the colorant transfer zone is the sum of the superficial extent of each individual recess and of the area of each land area.

It should be appreciated that the shaped cavity printing the principal pattern also contributes to trap dirt particles accumulating under the segment of the doctor blade axially co-extensive with the cavity. Accordingly, providing dirt trapping recesses circumferentially in alignment with this cavity is not an absolute necessity to prevent the doctor blade from clogging. However, this may be desirable in order to provide a print which has an enhanced aesthetic appeal.

Preferably, the array of recesses is constituted by elongated grooves which are axially and circumferentially spaced apart and extend obliquely with respect to the rotational axis of the printing roll. This feature is advantageous because the oblique grooves sweep longitudinally the leading edge of the doctor blade as the printing roll rotates, breaking-up flocs of fibers or other waste matter accumulating under the doctor blade. As a result, the grooves not only contribute to capture small dirt particles and carry them under the doctor blade but also serve to shear and break-up larger agglomerates of dirt particles to progressively dislodge same.

As embodied and broadly described herein, the invention also provides a printing roll for marking a fibrous web with a print, the printing roll comprising:

a first colorant transfer zone on a generally cylindrical peripheral surface of the printing roll, the first colorant transfer zone having a maximum axial dimension less than the length of the printing roll and defining a shaped cavity, whereby rolling contact between the printing roll and the fibrous web causing the first colorant transfer zone when coated with colorant to create a mark on the fibrous web according to a principal pattern determined by the shape of the cavity; and an array of recesses in a spaced apart relationship on the generally cylindrical peripheral surface, the array of recesses defining a second colorant transfer zone substantially surrounding the first colorant transfer zone and being capable of printing a background pattern on the fibrous web upon which the principal pattern is visually eminent, the first colorant transfer zone having a higher colorant holding capacity per unit area of the generally cylindrical peripheral surface than the second colorant transfer zone, whereby the zones print on the fibrous web contrasting marks forming the principal and background patterns, the array of recesses constituting means for collecting dirt particles adhering to the printing roll and being trained over the generally cylindrical peripheral surface when the generally cylindrical peripheral surface is subjected to a scraping action for removing excess colorant therefrom.

As embodied and broadly described herein, the invention also extends to a method for preventing build-up of dirt particles under a doctor blade scraping excess colorant from a printing roll which is in rolling contact with a fibrous web for printing on the fibrous web a principal pattern corresponding to a shaped cavity formed on a generally peripheral surface of the printing roll and defining a first colorant transfer zone having a maximum axial dimension less than the length of the printing roll, the method comprising the step of providing on the generally cylindrical peripheral surface an array of recesses in a spaced apart relationship substantially surrounding the first colorant transfer zone, the array of recesses constituting means for collecting dirt particles adhering to the printing roll and being trained over the generally cylindrical surface when the printing roll is subjected to a scraping action by the doctor blade for removing excess colorant therefrom, the array of recesses defining a second colorant transfer zone printing a background pattern on the fibrous web upon which the principal pattern is visually eminent, the first colorant transfer zone having a higher colorant holding capacity per unit area of the generally cylindrical peripheral surface than the second colorant transfer zone, whereby the zones print on the fibrous web contrasting marks forming the principal and background patterns.

DESCRIPTION OF A PREFERRED EMBODIMENT

Figure 1:
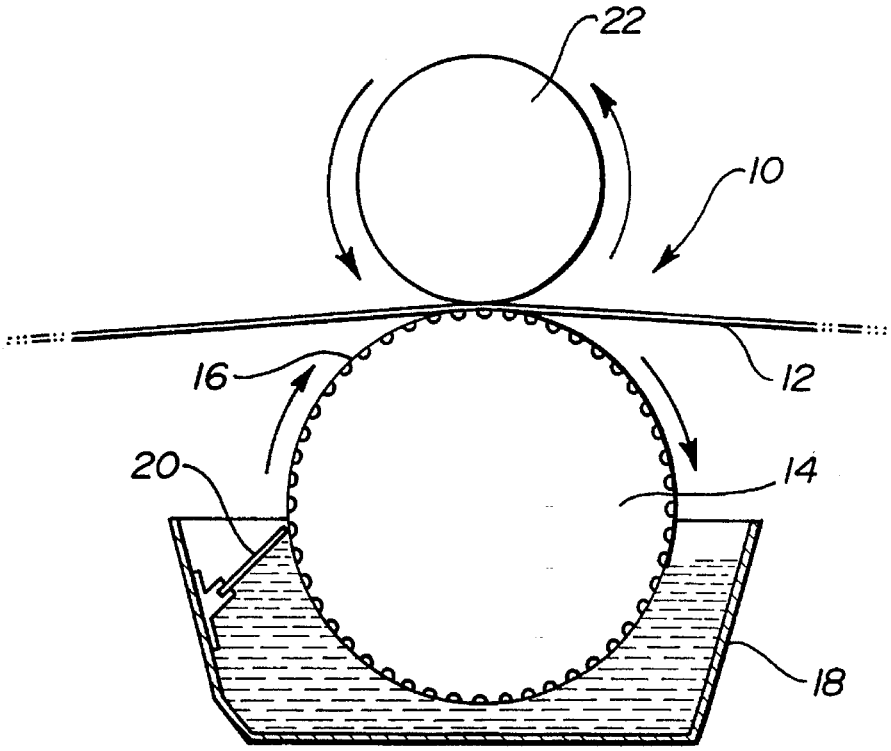
FIG. 1 is a vertical cross-sectional view of an apparatus for printing a fibrous web with a dual decorative pattern, constructed in accordance with the present invention.
Figure 3:
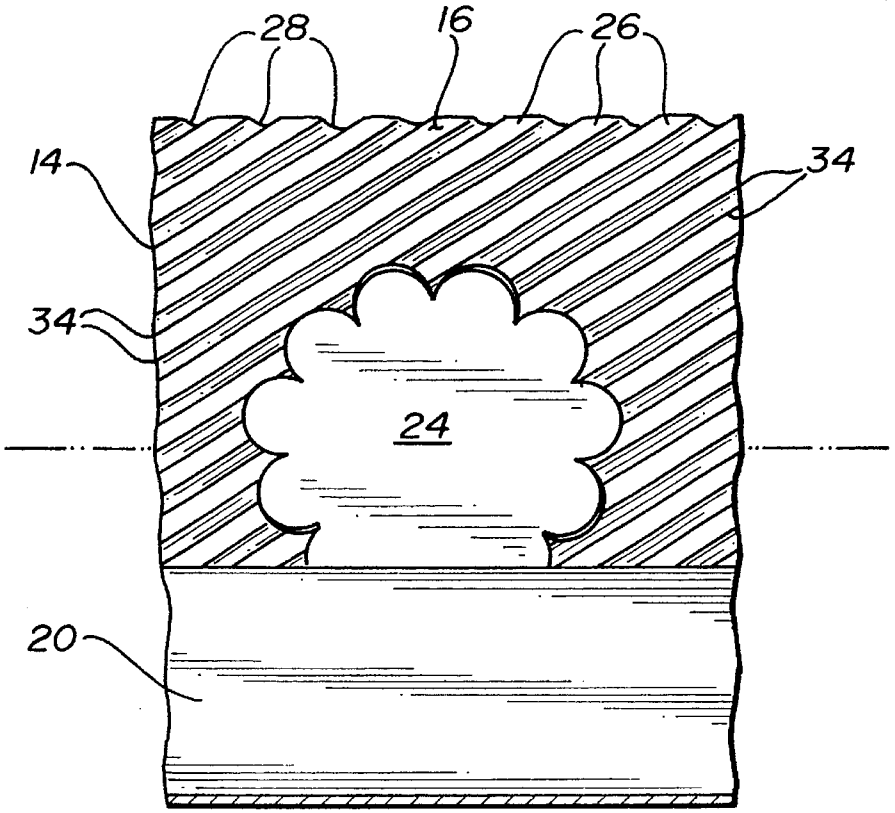
FIG. 3 is a further enlarged, fragmentary, front elevational view of the printing roll illustrating the process for inking the printing roll.

Referring now to the annexed drawings, more particularly to FIG. 1, a printing station, designated comprehensively by the reference numeral 10 is depicted therein for printing a dual decorative pattern on a continuously advancing fibrous web 12. For example, the fibrous web is a binder consolidated non-woven fabric manufactured by a fluid entanglement method disclosed in Canadian patent 1,143,929 issued to Johnson & Johnson U.S.A. on Apr. 5, 1983. The subject matter of this patent is incorporated herein by reference.

The printing station comprises an engraved printing roll 14 having a peripheral, relief surface 16 of a generally cylindrical configuration to imprint a mark on the fibrous web 12 in accordance with a predetermined pattern.

The lower portion of the printing roll 14 is immersed into a bath 18 of colorant, such as ink, that may comprise an agitator (not shown) to stir the ink in the bath to keep it homogenous. A drive system (not shown) rotates the printing roll 14 at substantially the same linear speed as the fibrous web 12, whereby the printing roll 14 is in rolling contact therewith. The rotation of the printing roll 14 in the ink bath 18 causes a film of ink to adhere to the printing roll 14, which is carried and deposited on the fibrous web 12 by the relief surface 16 to mark the non-woven fabric 12 with a print. To remove excess ink from the printing roll 14, a resilient doctor blade 20, made of spring steel material, is provided which has a leading edge slidingly and firmly engaging the relief surface 16.

A back-up roll 22 is provided above the printing roll 14 to form therewith a nip through which the fibrous web 12 passes. The purpose of the back-up roll 22 is to uniformly press the fibrous web 12 against the printing roll 14 during the printing operation.

The relief surface 16 as best shown in FIGS. 2 to 5 displays a shaped cavity 24, defining a primary ink transfer zone for printing a principal pattern on the fibrous web, for instance having the shape of a flower. In the example shown, the shaped cavity 24 is continuous. It may be envisaged to form the cavity 24 as a series of individual recesses grouped together to print a unitary pattern, the space between the individual recesses forming blanks in the mark impressed by the primary ink transfer zone.

Figure 5:
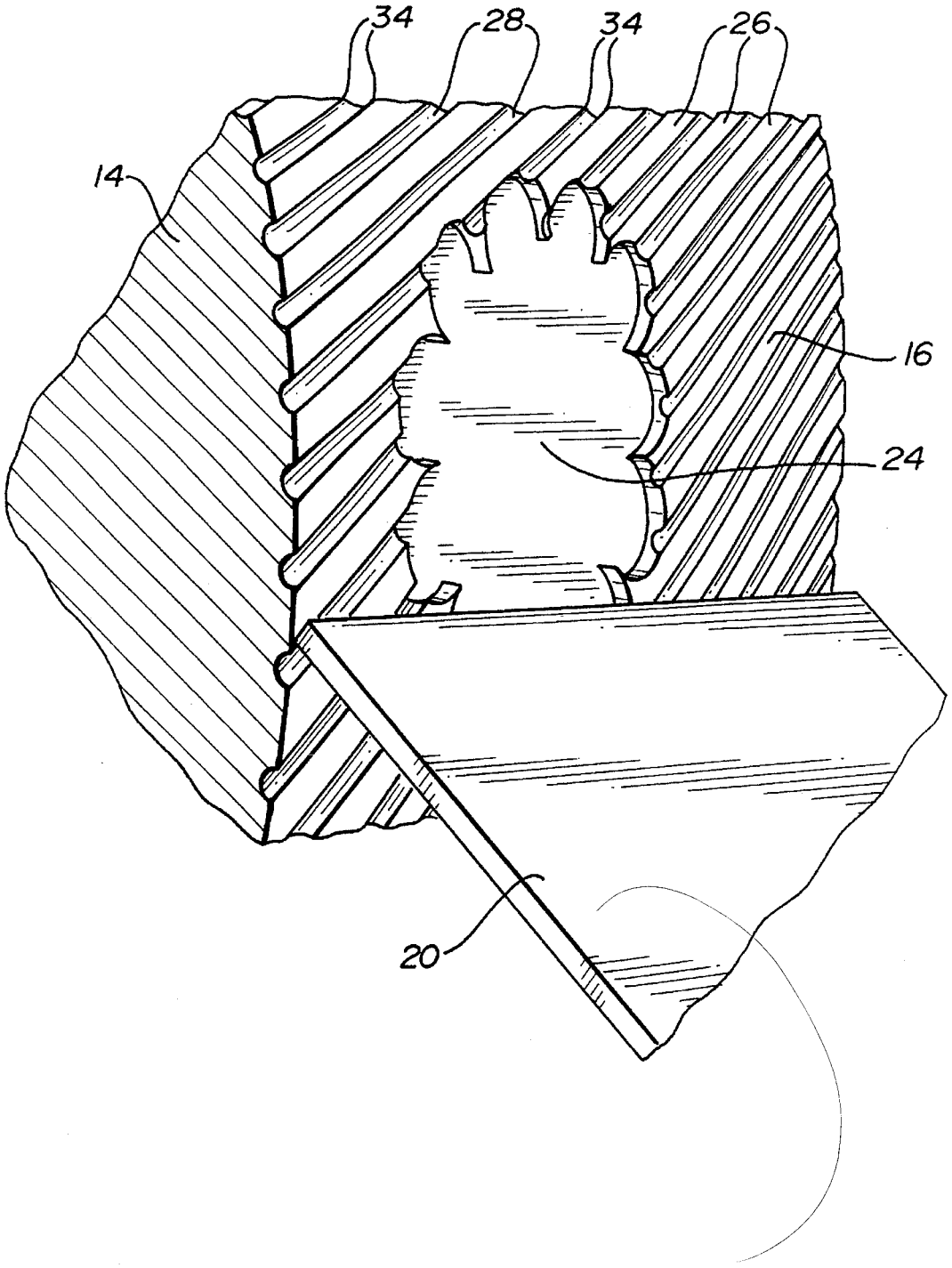
FIG. 5 is a perspective view of the printing roll shown in FIG. 3.
Figure 6:
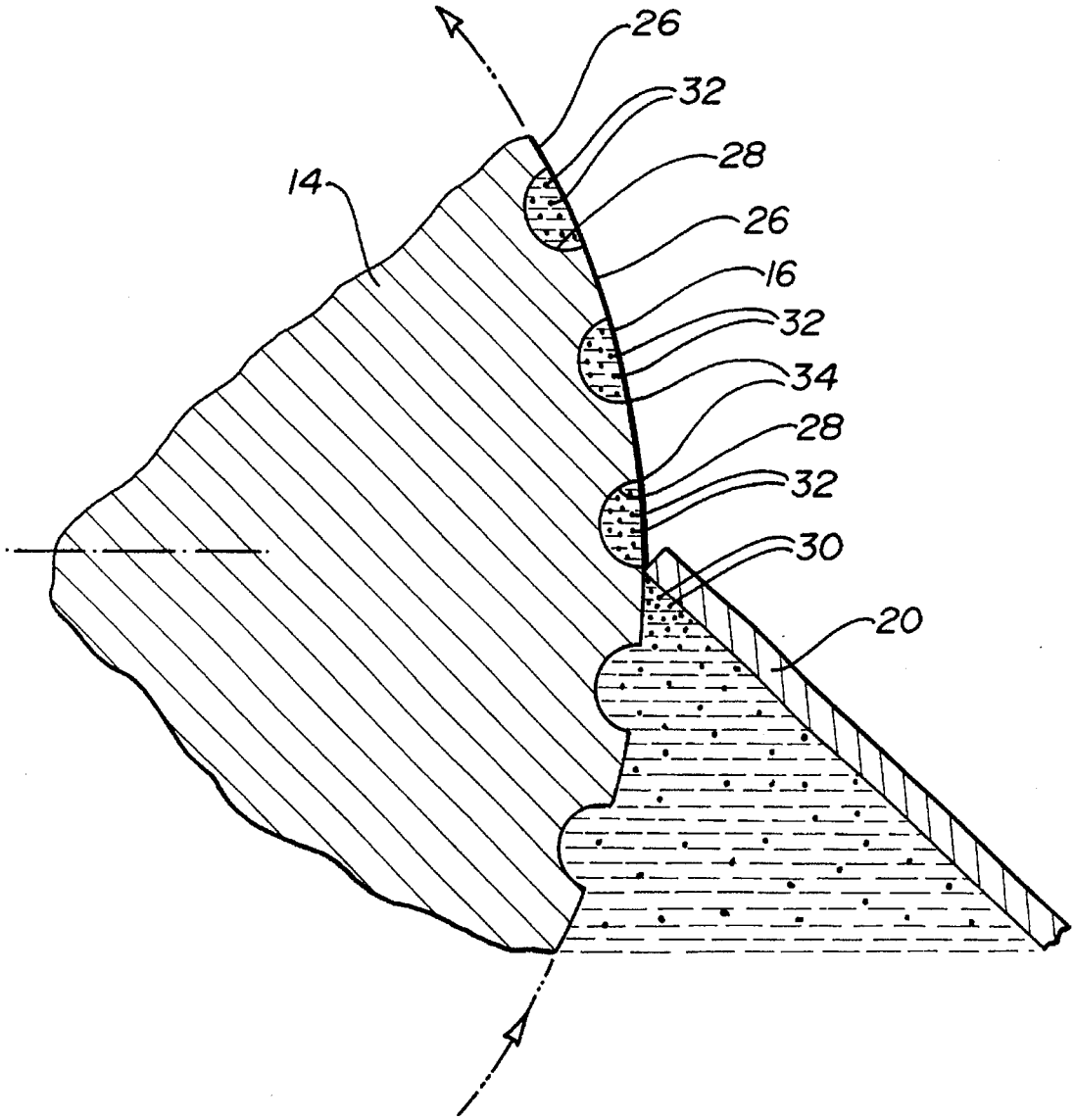
FIG. 6 is a highly enlarged, side elevational, fragmentary view of the printing roll, depicting the cleansing action of the grooves on the printing roll which are continuously dislodging dirt particles accumulating under the doctor blade.

The cavity 24 has a maximum axial dimension substantially less than the length of the printing roll 14 and it is surrounded by an array of recesses in a spaced-apart relationship uniformly distributed over the remaining of the relief surface 16 and defining therebetween land areas 26. In the example shown, the recesses are in the form of parallel grooves 28 inclined at a certain angle with respect to the rotational axis of the printing roll 14. There are two types of grooves, one shallow and the other one deeper, alternating. This feature is best shown in FIGS. 5 and 6.

Instead of providing a plurality of grooves, it may be envisaged to form a single, spiral groove which is continuous from one longitudinal extremity of the printing roll 14 to the other. In this case, the groove will have a constant depth.

Figure 7:
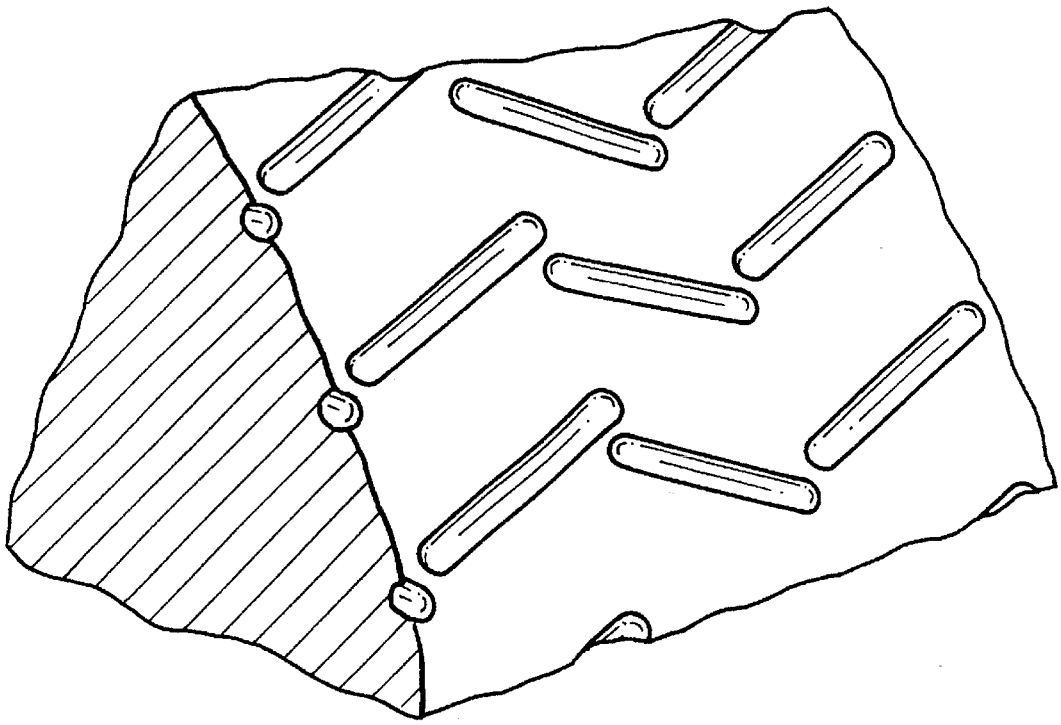
FIGS. 7, 8 and 9 are perspective fragmentary views of printing rolls illustrating possible recess schemes for cleaning the doctor blade.
Figure 8:
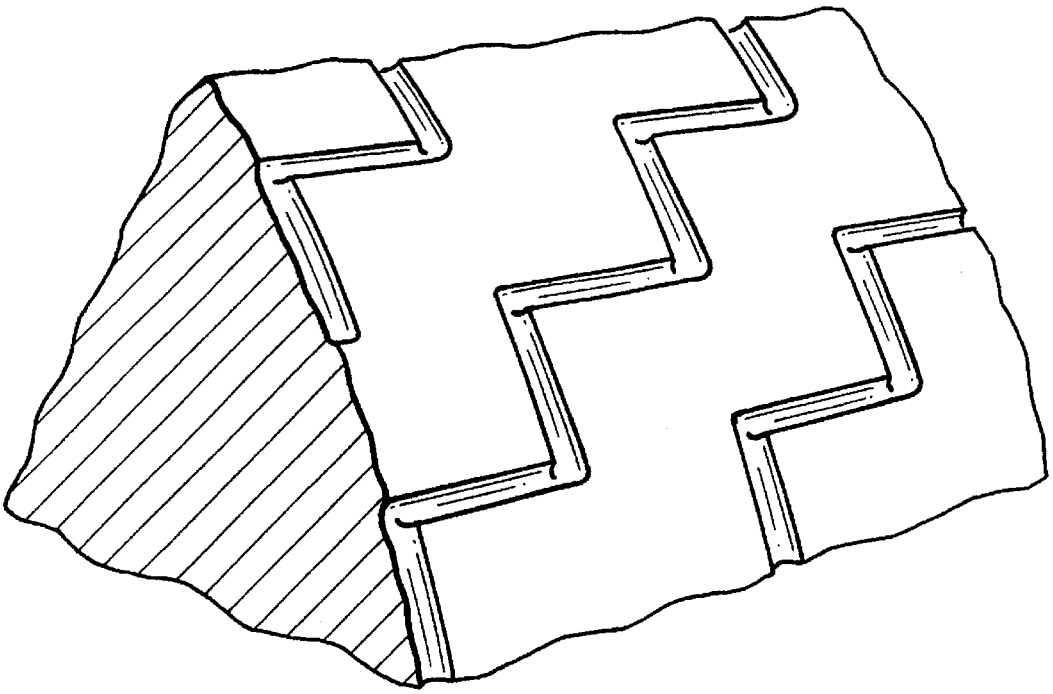
Figure 9:
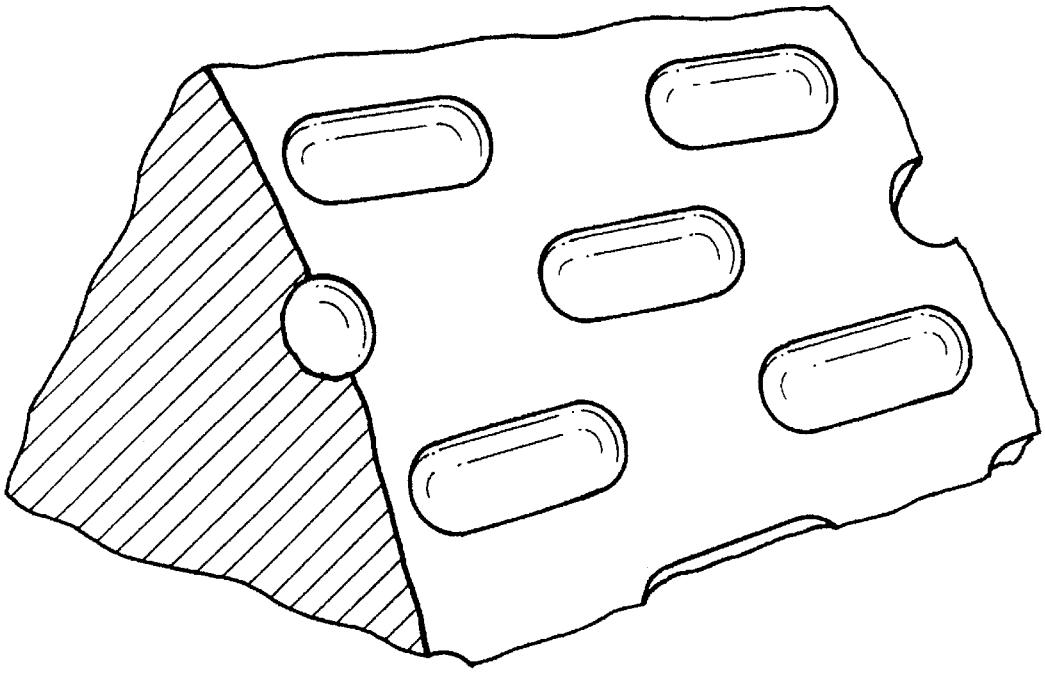

FIGS. 7 to 9 illustrate other possible recess patterns for cleaning the doctor blade 20.

To avoid possible ambiguities as to whether one or a plurality of recesses are present on the relief surface 16, segments of a continuous recess on the printing roll 14 which are axially spaced from one another will be considered as independent recesses, falling in the ambit of "plurality of recesses or grooves". However, if the segments are circumferentially aligned, i.e. contained in a common imaginary plane perpendicular to a rotational axis of the printing roll, they will be considered as a single recess. Accordingly, segments of a continuous spiral groove, which are axially spaced from one another, will fall under the first category. A straight groove, parallel to the axis of the printing roll will also fall in this category because a plurality of axially spaced segments may be arbitrarily defined in the straight groove. On the other hand, a circumferential groove contained into a plane which is perpendicular to the axis of the printing roll 14 falls under the second category since all segments that can be defined in the groove are in circumferential alignment.

Figure 2:
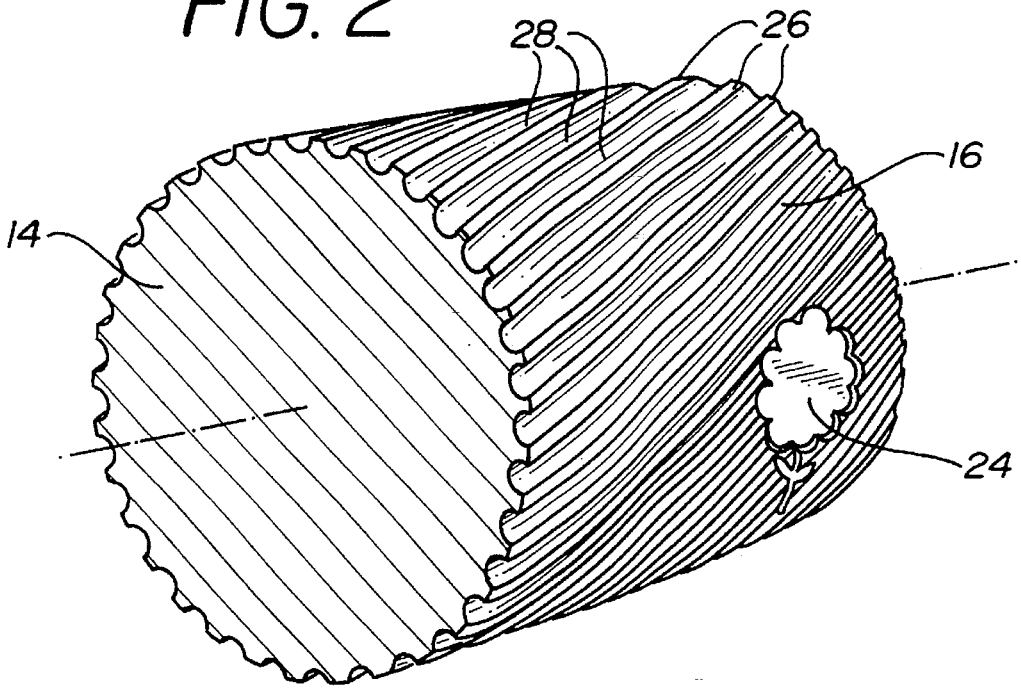
FIG. 2 is a perspective view of the printing roll of the apparatus illustrated in FIG. 1.

In the example shown in FIG. 2, the printing roll 14 is provided with a plurality of oblique grooves 28 which are generally parallel. According to the above definition, each groove 28 defines a plurality of recesses since one may arbitrarily divide the groove into a plurality of segments which are axially spaced from one another. It should be noted that these segments will also be circumferentially spaced from one another since the groove extends obliquely with respect to the axis of the printing roll 14.

Referring now to FIGS. 2 to 6, the array of grooves 28 entirely surrounds the cavity 24 and forms a secondary ink transfer zone printing a relatively faint background pattern upon which the principal pattern is visually eminent. The degree of distinctiveness between the two patterns is adjusted by varying the ink carrying capacity per unit area of the relief surface 16 of the primary and of the secondary ink transfer zones. The capacity of the primary ink transfer zone is higher than the capacity of the secondary ink transfer zone for printing a denser mark, i.e. a mark which per unit area of relief surface 16 has less voids and/or has a better hiding power than the mark printed by the secondary ink transfer zone. In the example shown, the cavity 24 has a superficial extent of 450 square millimeters ($mm^2$) and a depth of 0.152 millimeters (mm). Accordingly, its ink carrying capacity per unit area is of 15.2 cubic millimeters per square centimeter ($mm^3/cm^2$).

The secondary ink transfer zone has a total of 8 grooves per linear inch comprising 4 shallow grooves and 4 deep grooves printing a pattern of faint lines formed by the shallow grooves, alternating with denser lines formed by the deeper grooves. The grooves have a width of 0.305 mm and a depth of 0.051 mm and of 0.102 mm respectively. Accordingly, the ink carrying capacity of the secondary ink transfer zone is of 0.735 $mm^3/cm^2$, about one-twentieth the ink carrying capacity of the primary ink transfer zone.

During the operation of the printing roll 14, dirt particles such as small fibers or airborne contaminants, which are normally present in the environment of the printing station 10 are deposited on the printing roll 14 and tend to adhere to its surface which is somewhat tacky due to the presence of an ultra-fine ink pellicle on the land areas 26 which cannot be removed by the doctor blade 20 because it is very thin.

The doctor blade 20, sweeping the surface of the printing roll 14, collects the dirt particles which accumulate against the leading edge of the blade 20. If the dirt particles are allowed to agglomerate into large flocs, the resulting mass of waste fragments will locally prevent the doctor blade 20 from maintaining firm contact with the relief surface 16. As a result, excess ink would remain on the land areas 26, creating undesirable spots or streaks on the fibrous web 12.

Figure 4:
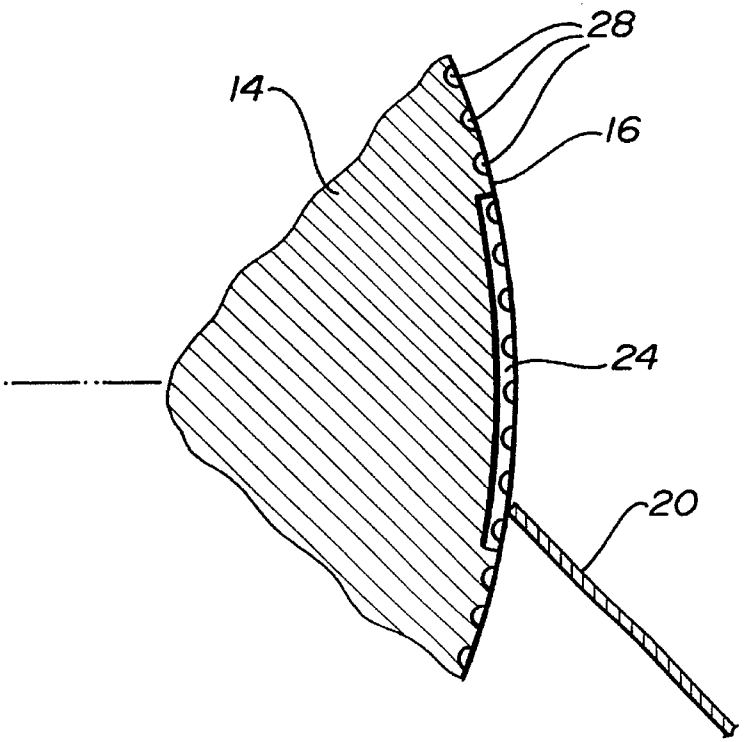
FIG. 4 is a cross-sectional view of the printing roll along lines 4–4 in FIG. 3.

By virtue of the grooves 28, such potential difficulty is avoided. The grooves 28 are sufficiently deep and as the doctor blade 20 sweeps over them, the dirt particles accumulating under the leading edge of the doctor blade 20 are driven into the grooves 28, thus clearing the doctor blade 20. As a result, the leading edge of the doctor blade 20 always remains clean and in firm contact with the relief surface 16. FIG. 4 best illustrates this process. The dirt particles accumulating under the doctor blade 20 are identified by the reference numeral 30. The dirt particles collected by the grooves 28 are identified by the reference numeral 32.

It has been observed that when the film of ink in the grooves 28 is deposited on the fibrous web 12, at least some of the trapped dirt particles are carried over to the fibrous web 12. Such self-cleaning action prevents the grooves 28 from becoming clogged during long periods of operation.

The oblique grooves 28 are also capable of breaking up larger flocs of dirt particles, due to the fact that the sharp edges 34 defined at the interface lines between the land areas 26 and the grooves 28 sweep longitudinally the doctor blade 20 as the printing roll 14 rotates. As a result, the grooves 28 not only dislodge the dirt particles from the doctor blade 20 but also progressively break-up and grind larger flocs until they clear the doctor blade 20.

In addition, it has been observed that the presence of the grooves 28 contributes to somewhat reduce the heating of the doctor blade 20 as a result of friction with the relief surface 16.

This printing roll structure has been found particularly advantageous allowing to print with high definition elaborate patterns over a wide variety of fibrous webs, even very coarse webs which have a tendency to release large amounts of loose fibers. The ability of the printing roll 14 to eliminate dirt particles adhering to its surface permits to maintain the printing roll 14 in operation during long time periods without the necessity of frequent cleaning cycles.

The distribution of the groves 28 over the relief surface 16 is important for achieving an optimum cleaning action of the doctor blade 20. Ideally, the number and disposition of grooves 28 should be such that each point on the leading edge of the doctor blade 20 is swept by a groove 28, whereby a dirt particle, irregardless of its axial location under the doctor blade 20 will eventually be collected into a groove 28 or into the cavity 24 which also contributes to dislodge dirt particles from the segment of the doctor blade 20 which sweeps the cavity 24 as the printing roll rotates.

A proper distribution of the grooves 28 on the printing roll 14 may also be established solely with relation to the land areas 26. Considering that the dirt particles accumulating under the doctor blade 20 are wiped-off the land areas 26, dirt particles will accumulate only under the segments of the leading edge of the doctor blade 20 which contact and wipe a land area 26. Accordingly, by providing grooves 28 which disrupt the circumferential continuity of the land areas 26, i.e. every possible imaginary circumferential line drawn around the printing roll 14 through a land area 26, and contained in a plane perpendicular to the axis of the printing roll 14 will invariably intercept a groove 28, an efficient cleaning of the doctor blade 20 would be achieved.

It should be appreciated that the array of grooves 28 does not need to extend on the portion of the relief surface 16 which is circumferentially aligned with the cavity 24 in order to provide an efficient cleaning action of the doctor blade 20 since the segment of the doctor blade swept by the cavity 24 is cleaned by it. However, it is preferred to extend the array of grooves 28 uniformly on the entire surface of the printing roll 14 around the cavity 24 to provide a continuity in the background pattern.

The scope of the present invention is not limited by the description, examples and suggestive uses herein, as modifications can be made without departing from the spirit of the invention. Thus, it is intended that the present application covers the modifications and variations of this invention provided that they come within the scope of the appended claims and their equivalents.

We claim:

1. An apparatus for printing a fibrous web, said apparatus comprising:

a rotary printing roll in rolling contact with said fibrous web for simultaneously printing thereon a principal pattern and a background pattern upon which the principal pattern is visually eminent, said printing roll including:

a) a generally cylindrical peripheral surface;

b) a first colorant transfer zone on said generally cylindrical peripheral surface defining a shaped cavity corresponding to said principal pattern and having a maximum axial dimension less than the length of said printing roll; and c) an array of recesses in a spaced apart relationship on said generally cylindrical peripheral surface, said array of recesses defining a second colorant transfer zone having a shape corresponding to said background pattern and substantially surrounding said first colorant transfer zone, and wherein said recesses define therebetween circumferentially discontinuous land areas, whereby every possible imaginary circumferential line contained in a plane perpendicular to a rotational axis of said printing roll and passing through a land area intercepts at least one recess of said array;

a colorant feed for coating said generally cylindrical peripheral surface with liquid colorant, said first colorant transfer zone having a higher colorant holding capacity per unit area of said generally cylindrical peripheral surface than said second colorant transfer zone, whereby said zones print on said fibrous web contrasting marks forming said principal and background patterns;

a stationary doctor blade scraping said generally cylindrical peripheral surface for removing excess colorant therefrom as said printing roll rotates, said doctor blade engaging dirt particles adhering on said generally cylindrical peripheral surface and training said dirt particles over said array of recesses which constitutes means for dislodging dirt particles accumulating against said doctor blade, thereby preventing said dirt particles from agglomerating into large flocs and interfering with the operation of said doctor blade.

2. An apparatus as defined in claim 1, wherein recesses of said array are axially and circumferentially spaced apart from one another.

3. An apparatus as defined in claim 1, wherein recesses of said array comprise elongated grooves.

4. An apparatus as defined in claim 3, wherein said grooves extend obliquely with respect to a rotational axis of said printing roll.

5. An apparatus as defined in claim 1, wherein said recesses define therebetween land areas, said recesses further defining sharp edges at respective interface lines with said land areas, said sharp edges longitudinally sweeping said doctor blade as said printing roll rotates to break-up agglomerates of dirt particles adhering to said doctor blade.

6. An apparatus as defined in claim 5, wherein said sharp edges extend obliquely with respect to a rotational axis of said printing roll.

7. An apparatus as defined in claim 1, wherein said recesses are uniformly distributed over said generally cylindrical peripheral surface except over said first colorant transfer zone.

8. A printing roll for marking a fibrous web with a print, said printing roll comprising:

a first colorant transfer zone on a generally cylindrical peripheral surface of said printing roll, said first colorant transfer zone having a maximum axial dimension less than the length of said printing roll and defining a shaped cavity, whereby rolling contact between said printing roll and said fibrous web causing said first colorant transfer zone when coated with colorant to create a mark on said fibrous web according to a principal pattern determined by the shape of said cavity; and an array of recesses in a spaced apart relationship on said generally cylindrical peripheral surface, said array of recesses defining a second colorant transfer zone substantially surrounding said first colorant transfer zone and being capable of printing a background pattern on said fibrous web upon which said principal pattern is visually eminent, said first colorant transfer zone having a higher colorant holding capacity per unit area of said generally cylindrical peripheral surface than said second colorant transfer zone, whereby said zones print on said fibrous web contrasting marks forming said principal and background patterns, said array of recesses constituting means for collecting dirt particles adhering to said printing roll and being trained over said generally cylindrical peripheral surface when said generally cylindrical peripheral surface is subjected to a scraping action for removing excess colorant therefrom; and wherein said recesses define therebetween circumferentially discontinuous land areas, whereby every possible imaginary circumferential line contained in a plane perpendicular to a rotational axis of said printing roll and passing through a land area intercepts at least one recess of said array.

9. A printing roll as defined in claim 8, wherein recesses of said array are axially and circumferentially spaced apart from one another.

10. A printing roll as defined in claim 8, wherein recesses of said array comprise elongated grooves.

11. A printing roll as defined in claim 10, wherein said grooves extend obliquely with respect to a rotational axis of said printing roll.

12. A printing roll as defined in claim 8, wherein said recesses define therebetween land areas, said recesses further defining sharp edges at respective interface lines with said land areas, said sharp edges being capable to sweep longitudinally a doctor blade in sliding contact with said printing roll as said printing roll is rotated to scrape excess colorant therefrom, in order to break-up agglomerates of dirt particles adhering to said doctor blade.

13. A printing roll as defined in claim 12, wherein said sharp edges extend obliquely with respect to a rotational axis of said printing roll.

14. A printing roll as defined in claim 8, wherein said recesses are uniformly distributed over said generally cylindrical peripheral surface except over said first colorant transfer zone.

15. A method for preventing build-up of dirt particles under a doctor blade scraping excess colorant from a printing roll which is in rolling contact with a fibrous web for printing on said fibrous web a principal pattern corresponding to a shaped cavity formed on a generally peripheral surface of said printing roll and defining a first colorant transfer zone having a maximum axial dimension less than the length of said printing roll, said method comprising the step of providing on said generally cylindrical peripheral surface an array of recesses in a spaced apart relationship substantially surrounding said first colorant transfer zone, said array of recesses constituting means for collecting dirt particles adhering to said printing roll which are being trained over said generally cylindrical surface when said printing roll is subjected to a scraping action by said doctor blade for removing excess colorant therefrom, said array of recesses defining a second colorant transfer zone printing a background pattern on said fibrous web upon which said principal pattern is visually eminent, said first colorant transfer zone having a higher colorant holding capacity per unit area of said generally cylindrical peripheral surface than said second colorant transfer zone, whereby said zones print on said fibrous web contrasting marks forming said principal and background patterns; and wherein said recesses define therebetween circumferentially discontinuous land areas, whereby every possible imaginary circumferential line contained in a plane perpendicular to a rotational axis of said printing roll and passing through a land area intercepts at least one recess of said array.

16. A method as defined in claim 15, comprising the step of forming recesses of said array axially and circumferentially spaced apart from one another.

17. A method as defined in claim 15, comprising the step of forming elongated grooves on said printing roll which constitute recesses of said array.

18. A method as defined in claim 17, comprising the step of forming said elongated grooves obliquely with respect to a rotational axis of said printing roll.

19. A method as defined in claim 15, comprising the step of providing sharp edges at interface lines defined between recesses of said array and land areas extending between recesses of said array, said sharp edges longitudinally sweeping said doctor blade as said printing roll rotates to break-up agglomerates of dirt particles adhering to said doctor blade.

20. A method as defined in claim 19, comprising the step of forming said sharp edges obliquely with respect to a rotational axis of said printing roll.

21. A method as defined in claim 15, comprising the step of distributing said recesses uniformly over said generally cylindrical peripheral surface except over said first colorant transfer zone.

* * * * *